US005639248A

United States Patent [19]

Yagi

[11] Patent Number: 5,639,248

[45] Date of Patent: Jun. 17, 1997

[54] ELECTRIC CONNECTOR ASSEMBLY FOR USE IN COUPLINGS TWO PRINTED BOARDS

[75] Inventor: Masanori Yagi, Sagamihara, Japan

[73] Assignee: Molex Incorporated, Lisle, Ill.

[21] Appl. No.: 644,294

[22] Filed: May 10, 1996

Related U.S. Application Data

[62] Division of Ser. No. 341,260, Nov. 17, 1994.

[30] Foreign Application Priority Data

Dec. 14, 1993 [JP] Japan ..... 5-072211

[51] Int. Cl.[6] ..... H01R 9/09

[52] U.S. Cl. ..... 439/74

[58] Field of Search ..... 439/74, 65, 83, 439/353, 354, 357

[56] References Cited

U.S. PATENT DOCUMENTS

| | | | |
|---|---|---|---|
| 4,113,179 | 9/1978 | McKee | 339/91 R |
| 4,734,060 | 3/1988 | Kawawada et al. | 339/660 |
| 5,074,039 | 12/1991 | Hillbish et al. | 29/883 |
| 5,161,985 | 11/1992 | Ramsey | 439/74 |
| 5,167,528 | 12/1992 | Nishiyama et al. | 439/489 |
| 5,176,541 | 1/1993 | Mori | 439/736 |
| 5,181,855 | 1/1993 | Mosquera et al. | 439/74 |
| 5,192,232 | 3/1993 | Lenz et al. | 439/660 |
| 5,199,884 | 4/1993 | Kaufman et al. | 439/74 |
| 5,201,883 | 4/1993 | Atoh et al. | 29/883 |
| 5,203,710 | 4/1993 | Miyazawa | 439/71 |
| 5,224,866 | 7/1993 | Nakamura et al. | 439/81 |
| 5,310,357 | 5/1994 | Olson | 439/346 |

FOREIGN PATENT DOCUMENTS 0 567 007 A3 10/1993 European Pat. Off. ..... H01R 23/72

*Primary Examiner*—P. Austin Bradley
*Assistant Examiner*—Yong Kim
*Attorney, Agent, or Firm*—James C. Paschall; Charles S. Cohen

[57] ABSTRACT

Disclosed is an improved electric connector assembly for use in coupling two printed boards. The height of such assembly is reduced yet a good effective length of contact beam and increased distance between the soldering tails of the opposite terminals is assured. Each female terminal is composed of a horizontal base, a contact beam rising from one end of the horizontal base and having contact near its top end. A transition descends from the other end of the horizontal base, and a soldering tail horizontally extends from the transition. The female terminals are attached to opposite side walls of their housing with their horizontal bases partly embedded in the opposite side walls.

15 Claims, 10 Drawing Sheets

ELECTRIC CONNECTOR ASSEMBLY FOR USE IN COUPLINGS TWO PRINTED BOARDS

This is a divisional of copending application Ser. No. 08/341,260 filed on Nov. 17, 1994.

FIELD OF THE INVENTION

The present invention relates to an electric connector assembly for use in coupling two printed boards.

DESCRIPTION OF THE PRIOR ART

Electric connector assemblies having a male part and a female part are used in coupling two printed boards. Electric connection can be made between the electric circuits of two printed boards by mating the male part attached to one of the two boards with the female part attached to the other boards. There has been an increasing demand for electric connectors of reduced height.

Japanese Patent Application Public Disclosure No. 5-144498 discloses such an electric connector assembly of reduced height. As seen from FIG. 19 herein, its female part has a pair of female terminals 2' arranged in opposite relationship and fitted in its housing. Each female terminal is composed of a vertical base section 3', a soldering tail 6' horizontally extending from one end of the vertical base section 3' and a contact 5' rising up from the other end of the vertical base section 3'. The opposite female terminals 2' are embedded by their base sections 3' in the floor 4' of the housing 1' of the female part, allowing their soldering tails 6' to lie under the bottom 7' of the housing 1', and at the same time, allowing their contacts 5' to remain in the terminal accommodating space in the housing 1'. As seen from the drawing, there are no recesses made in the bottom 7' of the housing 1' particularly in the vicinities of the transient parts from the soldering tails 6' to the vertical base section 3' of the opposite female terminals 2'.

The male part of the conventional electric connector has a pair of male terminals 10' arranged in opposite relationship and fitted in the housing 9'. Each male terminal 10' is composed of a vertical contact section, a soldering tail 13' horizontally extending from one end of the vertical contact section, a slanted transient section extending from the other end of the vertical contact section, and a vertical holding section 11' extending from the slanted transient section. The vertical holding section 11' of the opposite male terminals 10' are press fitted in the opposite slots 12' of the center leg of the housing 9' of the male part, allowing the soldering tails 13' to be extended laterally outward.

The prior art electric connector has following defects: (1) as the vertical extension of each female terminal 2' rises from the floor 4' of the female housing 1' the rising extension must be reduced with the reduction of connector's height until its resiliency is lowered, causing an adverse effect on the making of electric contact; (2) as each female terminal has a simple bending at the transient from the soldering tail to the vertical contact section, the distance L' between the opposite soldering tails 6' is reduced with reduction of connector's height accompanying reduction of lateral size so that it may be very difficult to arrange on a printed board, conductors apart enough to permit such conductors to be connected to the closest soldering tails; and (3) there are no recesses made on the bottom 7' of the housing 1' particularly in the vicinities of the transients 8' from the soldering tails 6' to the vertical contact sections 3', and therefore the soldering of the transients 8' of the female terminals 2' to conductors on the printed board is so difficult that there is a concern about incomplete soldering.

As for the male part, the vertical holding section 11' of the opposite male terminals 10' are press fitted in the opposite slots 12' of the center leg of the housing 9' of the male part, stressing the opposite slots 12' and potentially causing the undesired buckling of the male part housing apart from the female part housing. This tendency is liable to appear increasingly with the decrease of connector's height.

SUMMARY OF THE INVENTION

One object of the present invention is to provide an electric connector for use in coupling two printed boards, which electric connector structure meets the requirement of reduction of height, yet still assuring: first, a good resilient length of contact section in terminals; second, a good distance between the opposite soldering tails; third, no fear of permitting the rise of flux up to the terminal holding section at the time of soldering; fourth, a good solder joint at each soldering tail; fifth, no buckling of the male part housing apart from the female part housing; and sixth, reliable, high durability locking of the male and female parts.

To attain the object according to the present invention, an electric connector for use in coupling two printed boards comprising a male part having a plurality of pairs of male terminals longitudinally arranged and attached to its housing, and a female part having a plurality of pairs of female terminals longitudinally arranged and attached to its housing, the contacts of said male terminals being adapted to be put in contact with the corresponding contacts of said female terminals when said male and female parts are mated together, is improved in that: each of said female terminals is composed of a horizontal base, a contact beam rising from one end of said horizontal base and having a contact near its top end, a descent descending from the other end of said horizontal base, and a soldering tail horizontally extending from said descent, said female terminals being attached to the opposite side walls of the housing of the female part with their horizontal bases partly embedded in the opposite side walls, allowing their soldering tails to lie under the bottom of the housing, and at the same time, allowing their contact beams to be extended in the terminal accommodating space in which said male terminals are to be inserted when said male and female parts are mated together.

The bottom of the housing may have a recess made in the vicinity of the transient portion from the descent to soldering tail of each female terminal.

Each of said male terminals may be composed of a base, a contact beam rising from one end of said base and having a first catch at its top end, a second catch descending from the other end of said base, and a soldering tail horizontally extending from said second catch, said male terminals being attached to the opposite side walls of the housing of the male part with their first and second catches embedded in the top ends and floors of the opposite side walls, allowing their soldering tails to lie under the bottom of the housing, and at the same time, allowing their contact beams to extend in the terminal accommodating space defined in said female part when said male and female parts are mated together.

The bottom of the housing may have a recess made in the vicinity of the transient portion from the second catch to soldering tail of each male terminal.

The housing of said female part may have an elongated terminal mount in the space defined by its opposite side walls and opposite end walls, said elongated terminal mount having a latch member formed in the center of either opposite end wall, and the housing of said male part may have a catch member formed in the center of either opposite end wall, thereby permitting the housing of said female part and the housing of said male part to be locked when mated together.

With such arrangement as described above a good resilient length of contact section in each female terminal is assured by the resiliency provided by the horizontal base partly embedded in each side wall of the housing. Also, a good distance is assured between the opposite soldering tails because of additional horizontal base lengths. In addition, at the time of soldering there is no fear of permitting the rising of flux up to the terminal holding sections which are provided in the form of horizontal bases embedded in the opposite side walls because such terminal holding sections are not upright from the printed board as is the case with the conventional electric connector as shown in FIG. 19.

The soldering can be effected with ease thanks to the recess made on the housing bottom near each soldering tail-to-descent transient part of the female terminal.

No buckling of the male part housing can be caused because no stress appearing in the insert-molding of male terminals, different from the press-fitting of male terminals in the housing. Also, the soldering can be effected with ease thanks to the recess made on the housing bottom near each soldering tail-to-contact beam transient of the male terminal.

Finally, the reliable, high-durable locking of the male and female parts is assured because the locks and provided inside, not exposed directly to undesired impacts from the outside.

BRIEF DESCRIPTION OF THE DRAWINGS

Other objects and advantages of the present invention will be understood from the following description of electric connectors according to preferred embodiments of the present invention, which embodiments are shown in accompanying drawings.

DESCRIPTION OF PREFERRED EMBODIMENT

Figure 1:
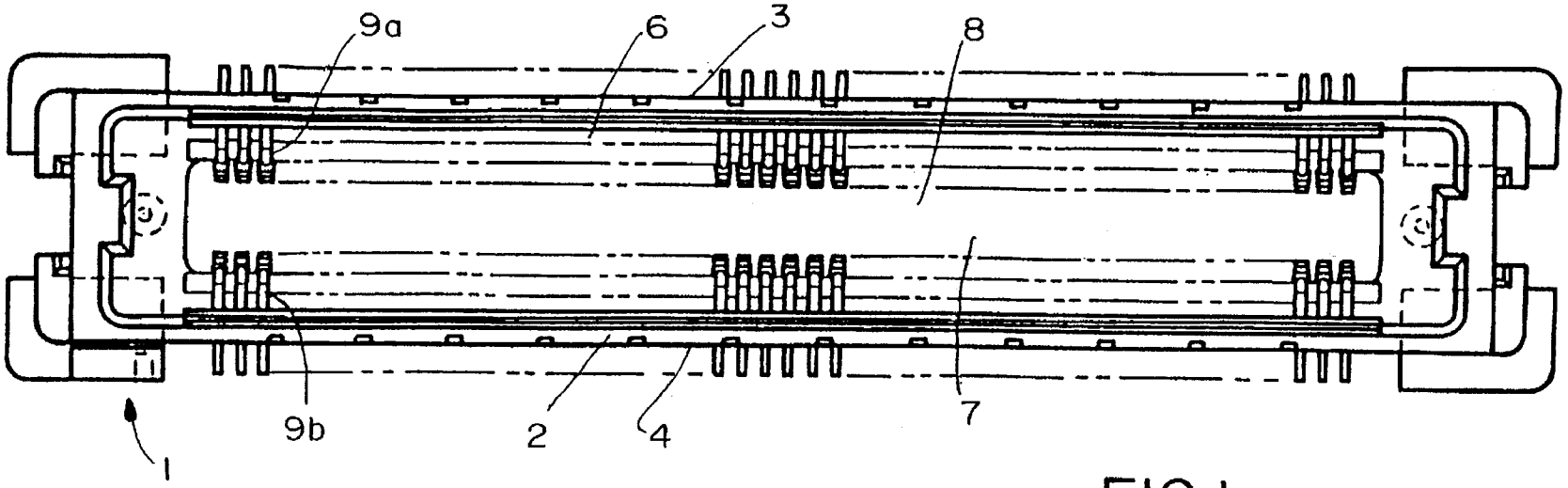
FIG. 1 is a plane view of a female part of an electric connector of a first embodiment of the present invention.

First, referring to FIGS. 1 to 4 and FIGS. 9 to 11, the female part 1 of an electric connector according to the first embodiment is described. The female part 1 has a housing 2 composed of opposite side walls 3 and 4, opposite end walls and a floor 5 together defining a space 6 to accommodate the contacts of the male part of the electric connector. The housing 2 has a center longitudinal projection 7, of which the top surface is used as a vacuum-sucking area 8 for pick and place purposes. The center section 7 is approximately the same height as the female terminals **9*a* and 9*b***.

Figure 2:
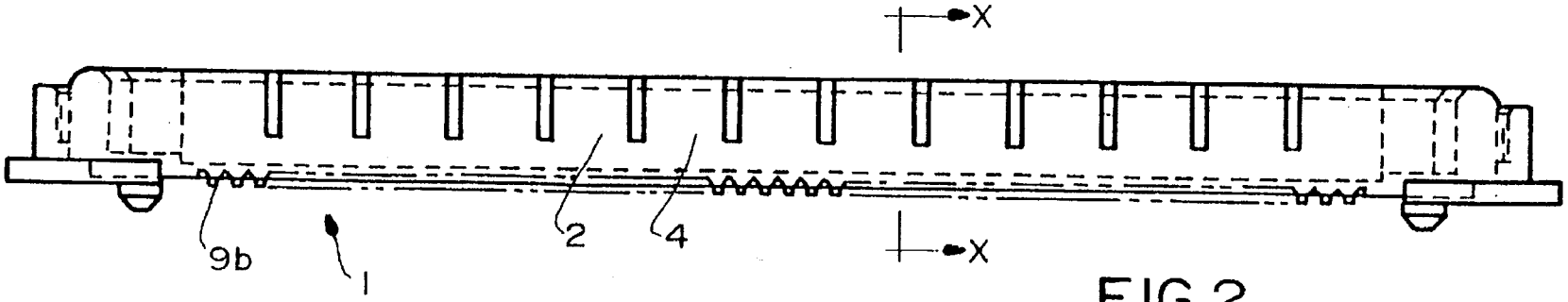
FIG. 2 is a right side view of the female part.
Figure 3:
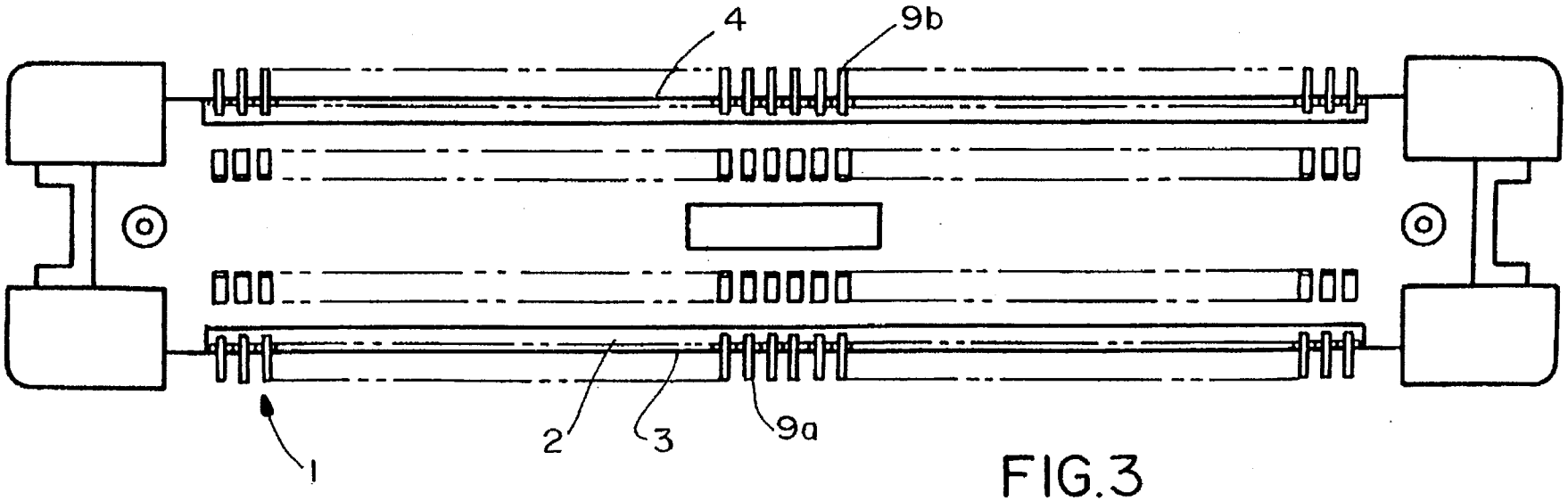
FIG. 3 is a bottom view of the female part.
Figure 4:
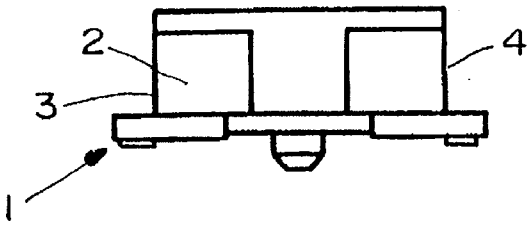
FIG. 4 is a front view of the female part.
Figure 5:
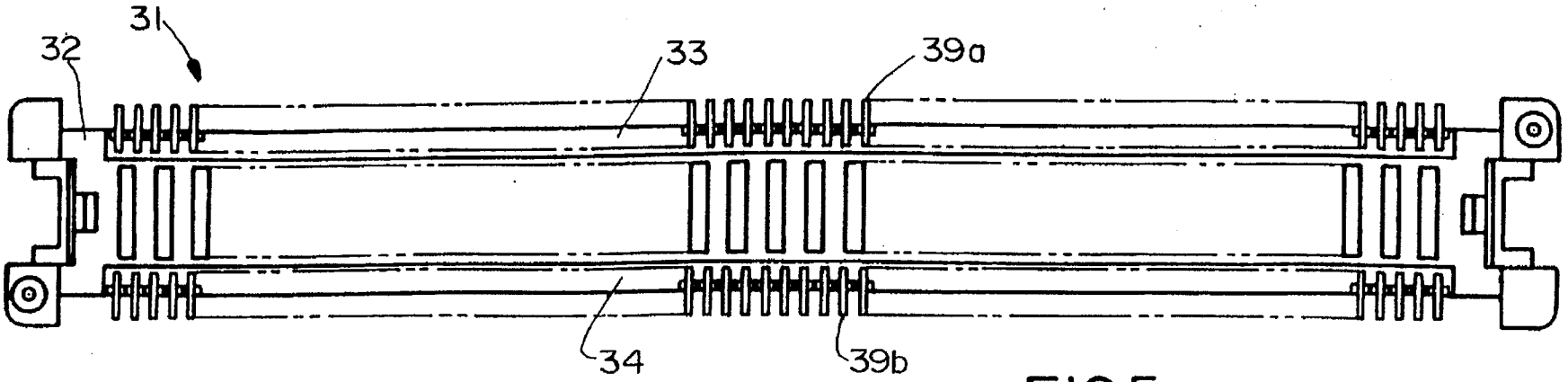
FIG. 5 is a plane view of a male part of the electric connector of the first embodiment of the present invention.
Figure 6:
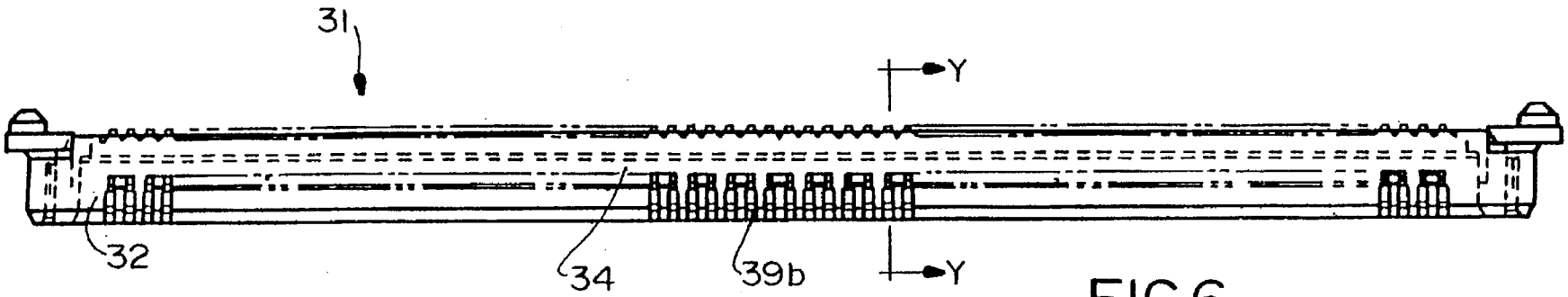
FIG. 6 is a right side view of the male part.
Figure 7:
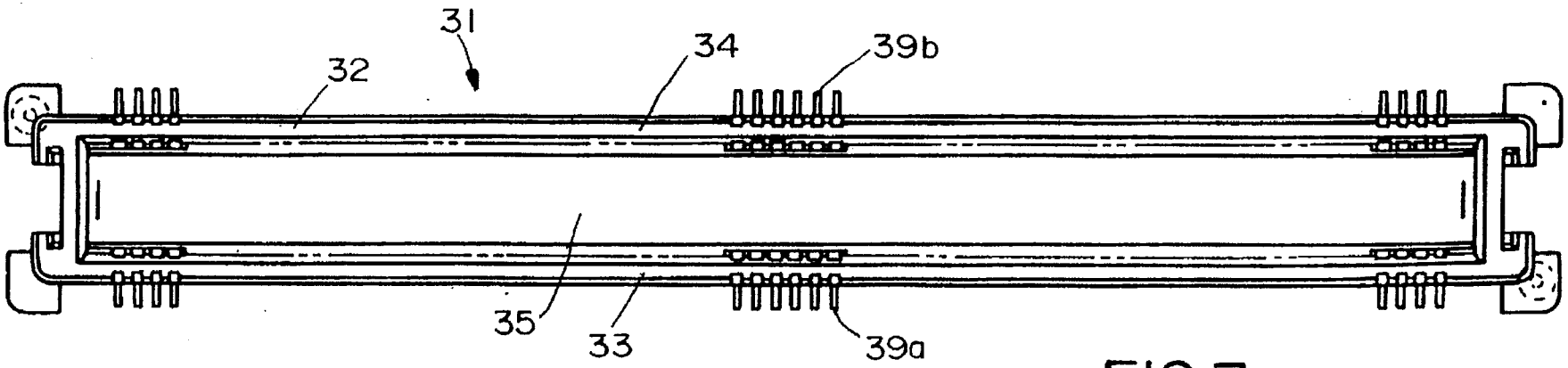
FIG. 7 is a bottom view of the male part.
Figure 8:
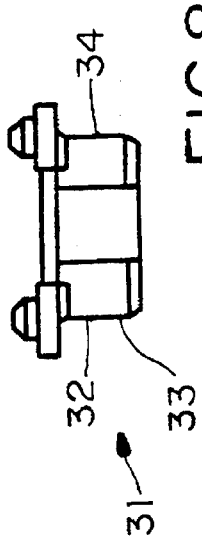
FIG. 8 is a front view of the male part.

As seen from FIGS. 1 to 3, a plurality of pairs of stamped and formed female terminals **9*a* (on left side) and 9*b* (on right side) are longitudinally arranged at regular intervals in the housing 2. A pair of female terminals are symmetrical in shape, and therefore, only one female terminal 9*b* is described with reference to FIG. 10**.

Each female terminal is composed of a horizontal base 10, a contact beam 13 rising from one end 11 of the horizontal base 10 and having a curved contact 12 near its top end, an angled descent 15 descending from the other end of the horizontal base 10, and a soldering tail 16 horizontally extending from the descent 15.

Such female terminals **9*a*, 9*b* are attached to the opposite side walls 3 and 4 of the housing 2 of the female part 1 with their horizontal bases 10 embedded partly (as indicated at 10*a*) in the opposite side walls 3 and 4 as for instance by insert molding allowing their soldering tails 16 to lie below the bottom 18 of the housing 2, and at the same time, allowing their curved contact beams 13 to be extended in the terminal accommodating space 6 in which the male terminals 39*a*, 39*b* are to be inserted when the male and female parts 31 and 1 are mated together. As seen from FIG. 9, the exposed portion 10*a* of each horizontal base 10 is laid on the floor 5. A triangular portion 3' and 4' of each sidewall extends into space 6 towards projection 7** to help secure the terminal in place.

The bottom 18 of the housing 2 has a recess 19 made near the transient portion 17 from the descent 15 to the soldering tail 16 of each female terminal **9*a* or 9*b*. A hole 18' is provided to permit the deflectable portion 10*b* of horizontal base 10** to deflect and to allow the terminal to be supported during the overmolding process used to manufacture the connector.

Next, referring to FIGS. 5 to 8 and FIG. 12, the male part 31 of the electric connector according to the first embodiment is described. The male part 31 has a housing 32 composed of opposite side walls 33 and 34, opposite end walls and a floor 35, together defining a space 36 to accommodate the contact beams of the female part of the electric connector. The floor 35 is sufficiently smooth to permit it to be used as a vacuum sucking area for pick and place purposes.

As seen from FIG. 5 to 8, a plurality of pairs of male terminals **39*a* (on left side) and 39*b* (on right side) are longitudinally arranged at regular intervals in the housing 32. A pair of male terminals are symmetrical in shape, and therefore, only one male terminal 39***a* is described with reference to FIG. 12.

Each male terminal is composed of a base 40, a contact beam 43 extending from one end 41 of the base 40 and having a first catch 42 at one end, a second catch 45 descending from the other end of the base 40, and a soldering tail 46 horizontally extending from the second catch 45. The exposed surface of the contact beam 43 provides a contact section 48.

The male terminals 39*a*, 39*b* are attached to the opposite side walls 33 and 34 of the housing 32 of the male part with their first and second catches 42 and 45 embedded in the top ends and floors 35, respectively, of the opposite side walls 33 and 34 as for instance by insert molding, allowing their soldering tails 46 to lie under the bottom 49 of the housing 32, and at the same time, allowing their contact beams 43 to extend in the terminal accommodating space 36 defined in the female part 1 when the male and female parts 31 and 1 are mated together. As seen from FIG. 12, each contact beam 43 extends along side wall 33 or 34, permitting its exposed surface to be used as contact. The bottom 49 of the housing 32 has a recess 50 made near the transient portion 51 from the second catch to the soldering tail 46 of each male terminal 39*a* or 39*b*.

The manner in which such electric connector is used is described below. First, the female part 1 is attached to one printed board 21 by soldering the soldering tails 16 of the female terminals 9*a* and 9*b* to selected conductors of one printed board 21.

Figure 9:
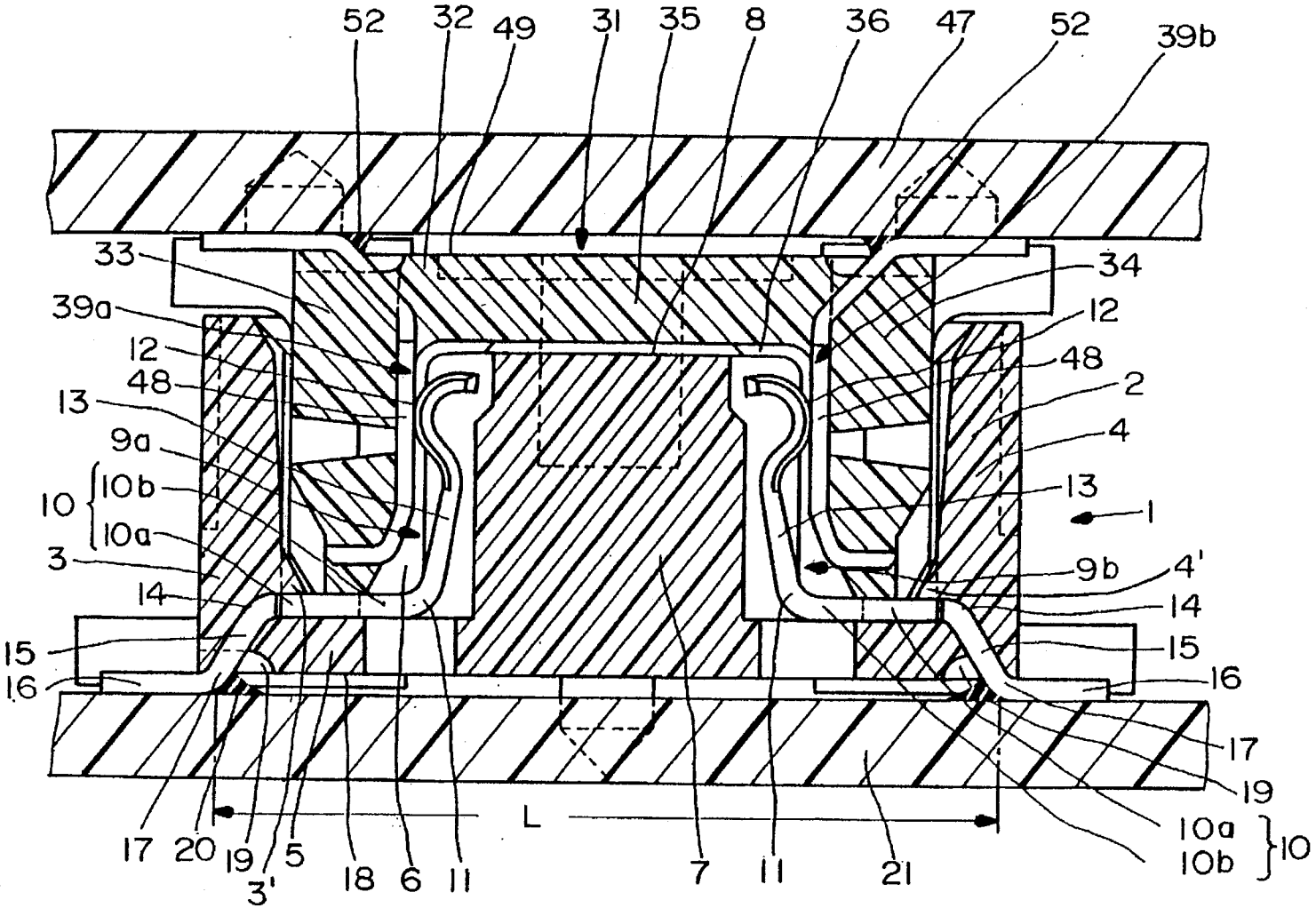
FIG. 9 is a cross section taken along the line X—X in FIG. 2 and along the line Y—Y in FIG. 6, showing the manner in which the male and female parts are mated together.
Figure 10:
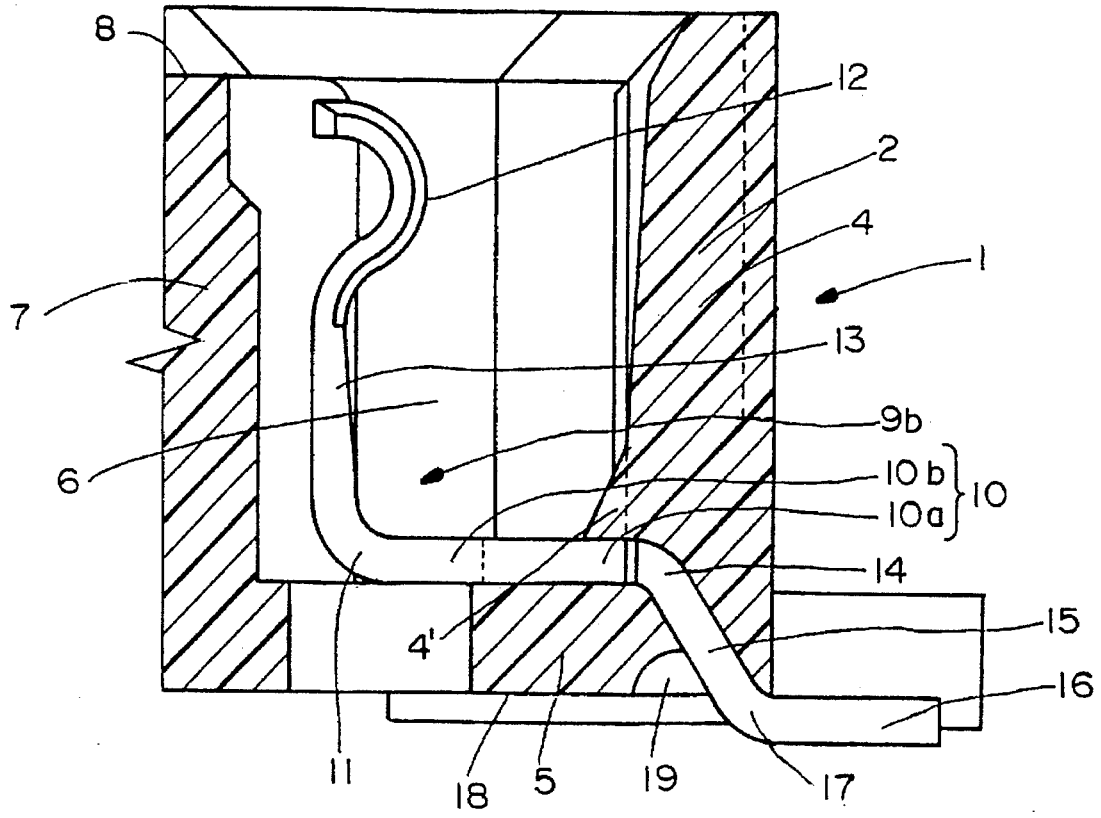
FIG. 10 is an enlarged section showing a female terminal fixed to the housing of the female part.
Figure 11:
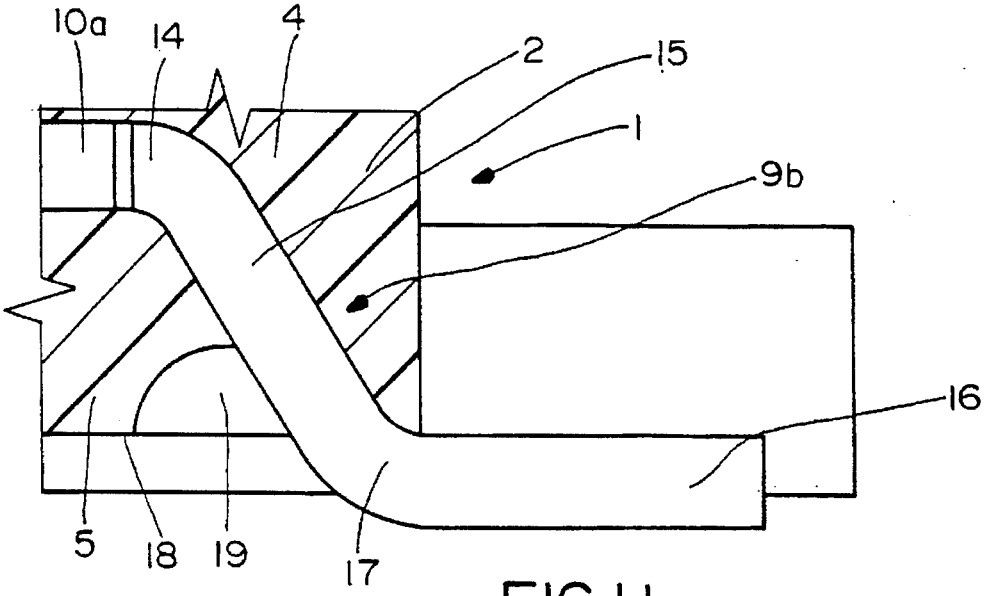
FIG. 11 is an enlarged section of a recess made in the bottom of the housing of the female part.

As seen from FIG. 9, the soldering tails 16 of the opposite female terminals 9*a* and 9*b* are separated a relatively long distance 1, thanks to the extra lengths of horizontal bases 10 regardless of the reduction of connector height, thus permitting selected conductors on the printed board to be soldered to the soldering tails 16 with ease.

As indicated at 20 in FIG. 9, the soldering is effected to the soldering tail-to-descent transient 17 at the recess 19, which facilitates the precision soldering to selected conductors on the printed board.

On the other hand the male part 31 is attached to the other printed board 47 by making use of the recesses 50 on the bottom 49 of the housing 35 to solder the soldering tail to second catch transients 51 of the male terminals 39*a* and 39*b* to selected conductors of the other printed board 47 with ease and high precision.

When the male and female parts are mated together, the contact sections 48 of the opposite male terminals 39*a* and 39*b* contact the curved contacts 12 of the opposite female terminals 9*a* and 9*b* to make the required electric connections. Even if the contact beams 13 of the opposite female terminals 9*a* and 9*b* are reduced with reduction of connector's heights, the lengths 10*b* of the horizontal bases 10 function as resilient means, thereby adding extra resilience to the shortened contact beams 13 of the opposite female terminals 9*a* and 9*b* to assure the sufficient effective length of resilience to permit application of the curved contacts 12 against the contact beams 4 with required contact pressure independent of reduction of connector's height.

Figure 13:
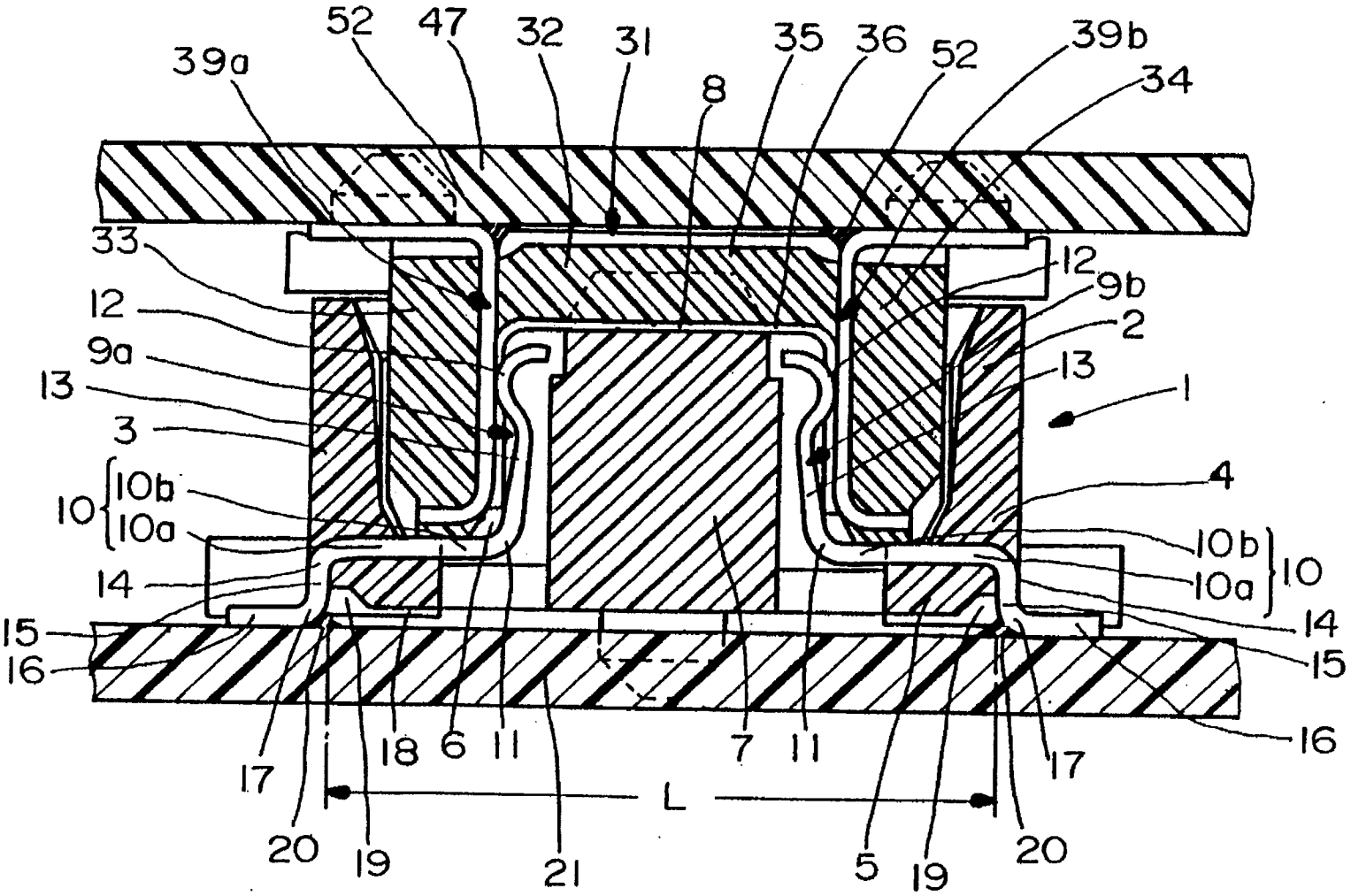
FIG. 13 is a cross section similar to FIG. 9, but showing the manner in which the male and female parts of an electric connector according to a second embodiment of the present invention are mated together.

FIG. 13 shows an electric connector according to another embodiment, which is different from the electric connector of FIG. 9 only in that the descents 15 stand upright. The so modified electric connector can attain the same function and advantage as the electric connector of FIG. 9.

Finally, referring to FIGS. 14 to 18, the locking of the male and female parts is described below. The housing 2 of the female part 1 has an elongated terminal mount 60 in the space defined by its opposite side walls 3 and 4 and opposite end walls 61 and 62, as seen from FIGS. 16 and 17. The elongated terminal mount 60 has a plurality of female terminals 9*a* and 9*b*, and the terminal mount has a latch member 55 formed in the center of either or both of opposite end walls 58 and 59. The latch member 55 projects from the free end of resilient J-shaped arm 54 integrally connected to the lower part of the end wall 58, as seen from FIG. 17.

Figure 15:
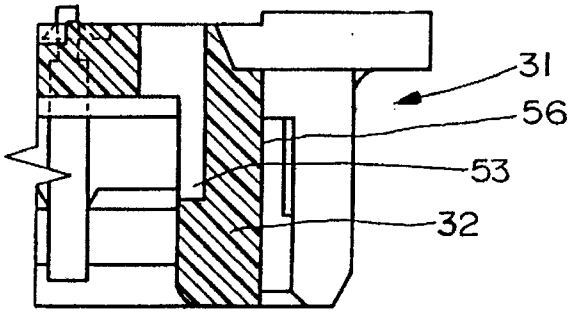
FIG. 15 is a section taken along the line Z—Z in FIG. 14.
Figure 19:
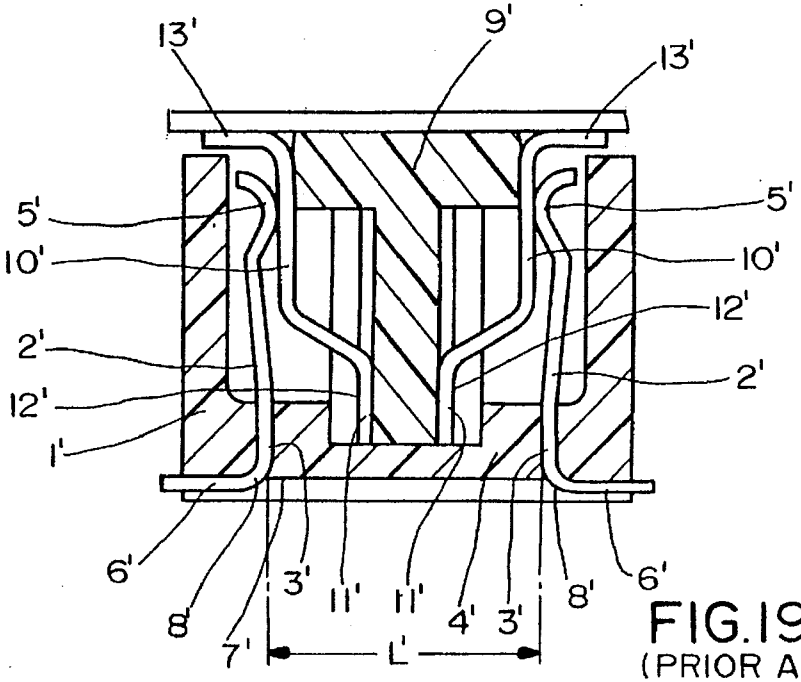
FIG.19 (PRIOR ART)
FIG. 19 is a cross section showing a conventional electric connector.
Figure 12:
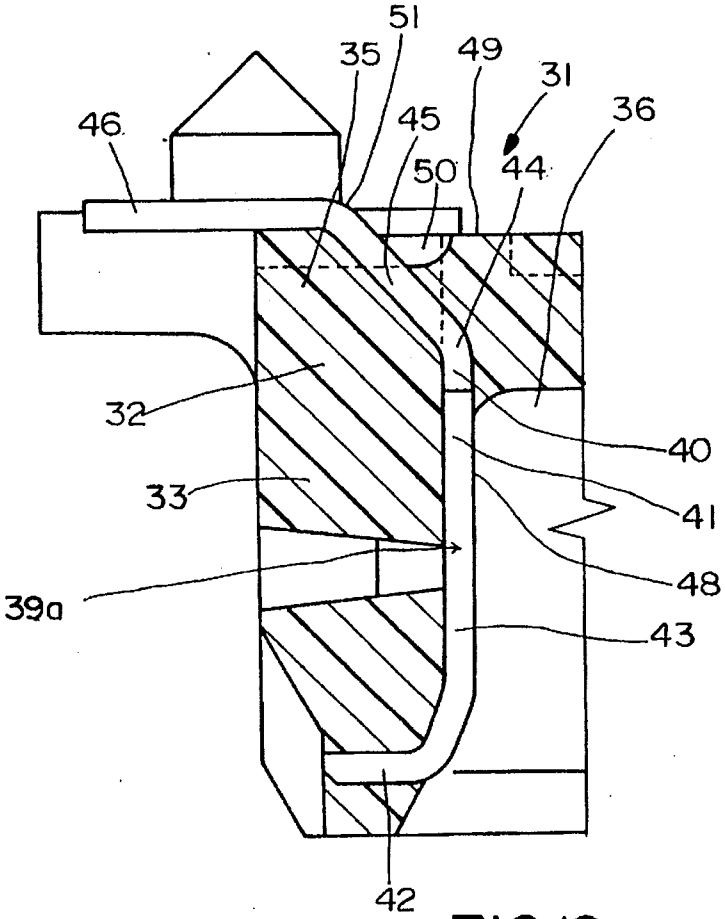
FIG. 12 is an enlarged section showing a male terminal fixed to the housing of the male part.
Figure 14:
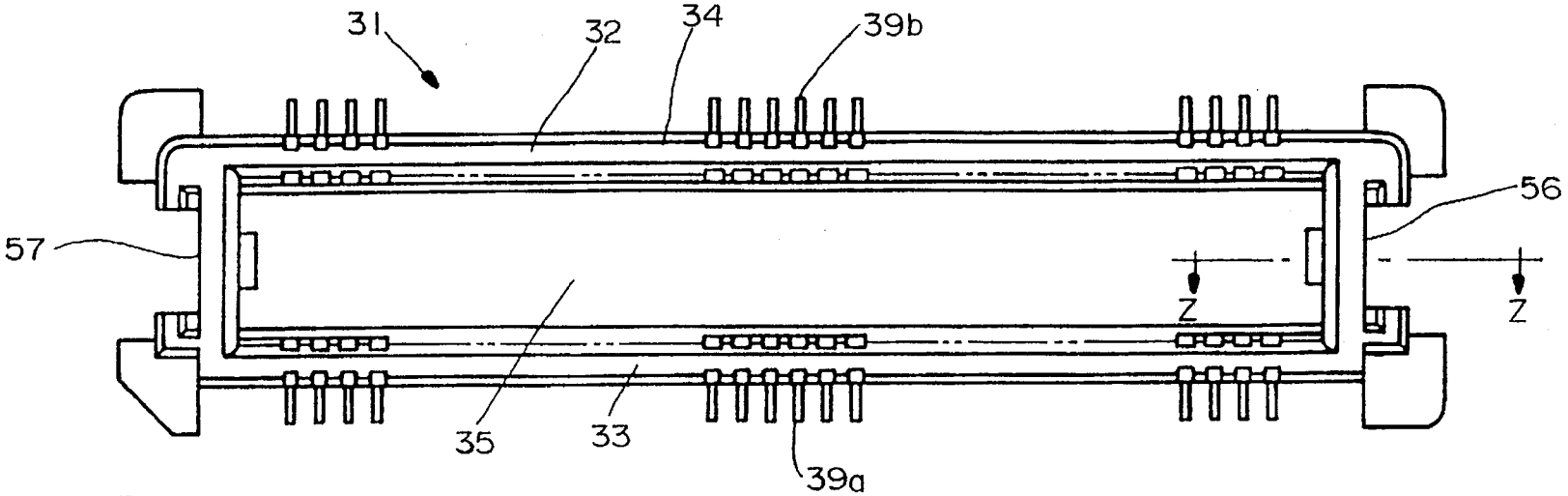
FIG. 14 is a bottom view of a male part of an electric connector according to a third embodiment of the present invention.
Figure 16:
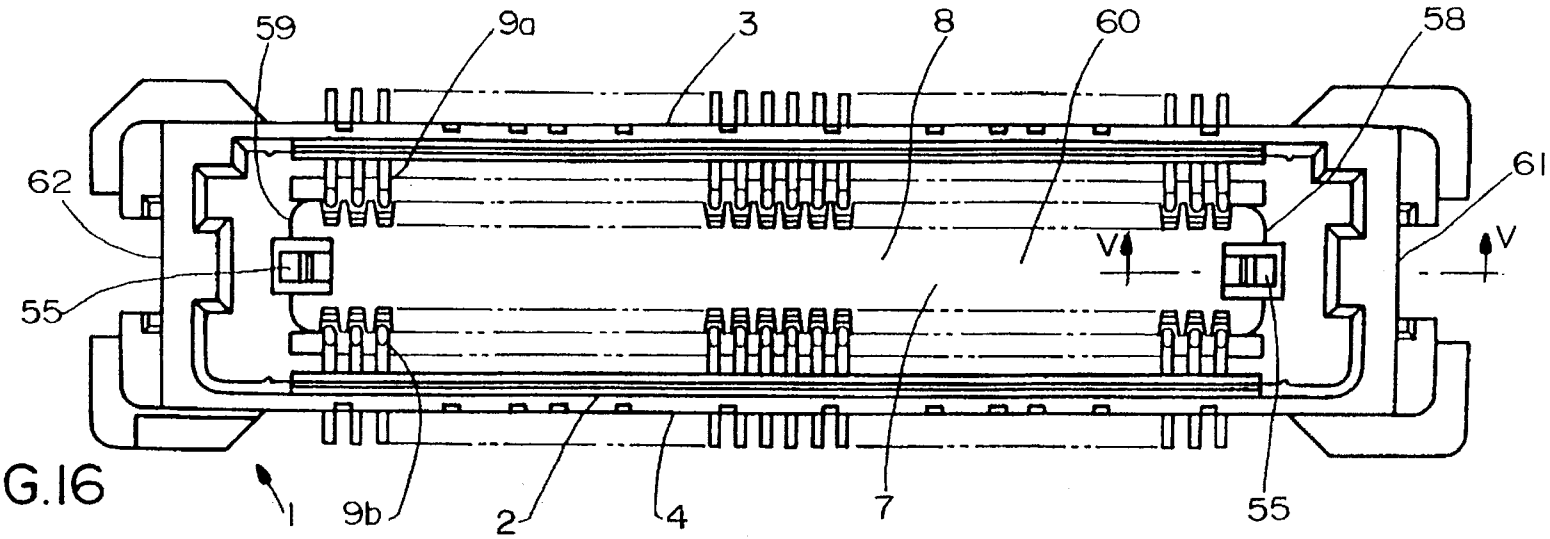
FIG. 16 is a plan view of a female part of an electric connector according to a fourth embodiment of the present invention.
Figure 17:
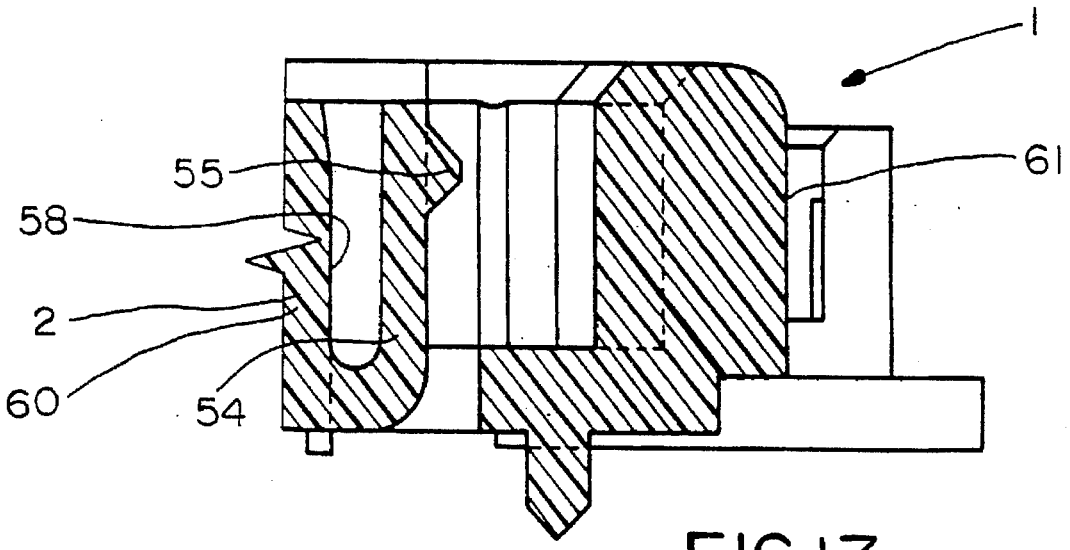
FIG. 17 is a section taken along the line V—V in FIG. 16.
Figure 18:
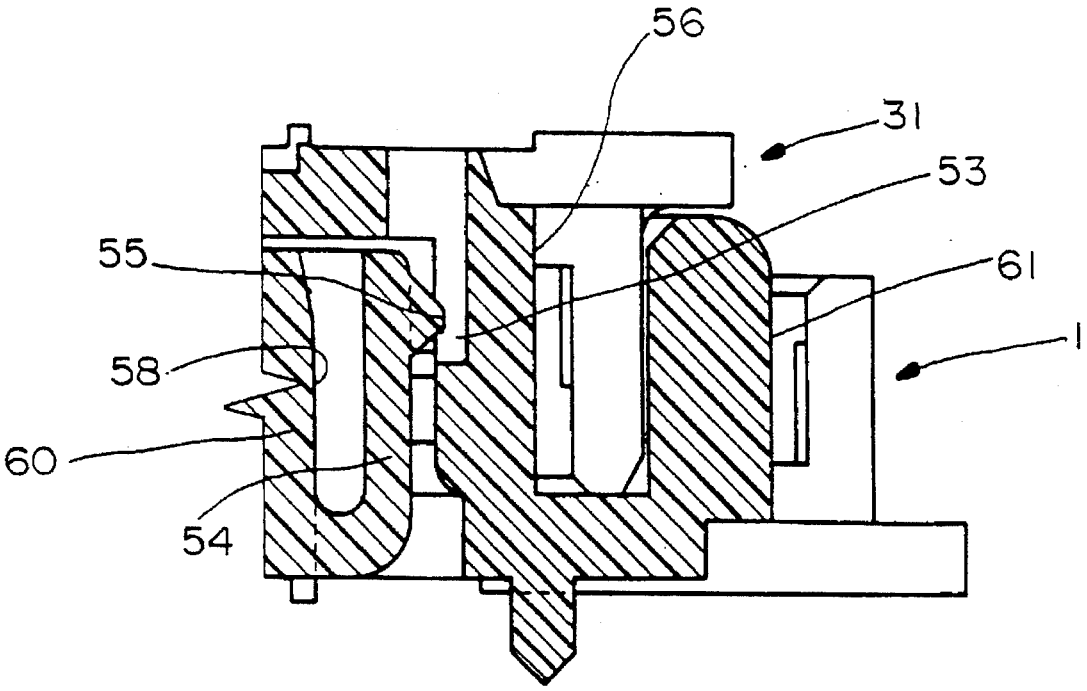
FIG. 18 is a section partly showing the mating of the female part of FIG. 16 and the male part of FIG. 14.

As seen from FIGS. 14 and 15, the housing 32 of the male part 31 has a catch member 53 formed in the inside, center of either or both of opposite end walls 56 and 57. In this particular example, the catch member 53 is made in the form of slot. Thus, the housing 2 of the female part 1 and the housing 32 of the male part 1 are locked to each other when mated together.

Specifically, when the male part housing 32 is inserted in the female part housing 2, the latch members 55 of the opposite end walls 58 and 59 of the terminal mount 60 of the female part housing 2 fit in the slots 53 on the inside surfaces of the opposite end walls 56 and 57 of the male part housing 32, thereby locking the male part to the female part. The locking is effected inside, and therefore, is insensitive to undesired impacts from the exterior, and accordingly the locking parts are durable.

It will be appreciated by those skilled in the art that the embodiments of the present invention disclosed herein are merely illustrative of some of the applications of this invention and that numerous modifications may be made by those skilled in the art without departing from the true spirit and scope of this invention.

I claim:

1. An electrical connector assembly for use in coupling two circuit members comprising a male part having a plurality of pairs of male terminals longitudinally arranged and mounted in a male housing and a female part having a plurality of pairs of female terminals longitudinally arranged and mounted in a female housing, said male housing having a pair of spaced-apart side walls connected by end walls, said side walls and said end walls extending from a base of said housing, each of said pairs of male terminals having a contact beam mounted adjacent a respective one of said side walls and being adapted to engage corresponding contacts of said female terminals when said male part and said female part are mated together, characterized in that:

each of said male terminals includes a first catch extending from a first end of said contact beam, a second catch extending from a second end of said contact beam, and a soldering tail extending from said second catch, a length of said first catch of each of said male terminals being embedded in a portion of said respective one of said side walls and a length of said second catch of each terminal being embedded in a portion of said base of said male housing.

2. An electrical connector assembly according to claim 1 wherein said male part includes an opening to accommodate a portion of the female housing.

3. An electrical connector assembly according to claim 1 wherein said terminal is bent at said first end to facilitate insertion of the portion of the female housing.

4. An electrical connector assembly according to claim 1 wherein said male housing has an aperture through said side wall adjacent to said contact beam for insertion of a support therethrough to support said terminal during molding.

5. An electrical connector assembly according to claim 1 wherein said first catch and said tail are generally parallel.

6. An electrical connector assembly according to claim 1 wherein said first catch and said contact beam are generally perpendicular.

7. An electrical connector assembly according to claim 1 wherein said male housing includes a surface of said base having a recess adjacent a junction of said second catch and said soldering tail of each male terminal.

8. An electrical connector for mating with a complementary electrical connector, said electrical connector comprising:

a dielectric housing including a pair of spaced apart generally parallel side walls interconnected by spaced apart generally parallel end walls, and a base of said housing;

a plurality of terminals mounted therein, each said terminal having a contact beam mounted adjacent to a respective one of said side walls and having a first end and a second end, a first catch extending from said first end, a length of said first catch being embedded within a portion of said respective one of said side walls to retain said terminal within said housing, a second catch extending from said second end, a length of said second catch being enclosed within a portion of said base of said housing, and a tail extending from said second catch for interconnecting said terminal to an electrical circuit of a circuit member upon which said electrical connector is adapted to be mounted.

9. An electrical connector assembly according to claim 8 wherein said connector includes an opening to accommodate a portion of said complementary electrical connector.

10. An electrical connector assembly according to claim 8 wherein said opening has a chamfered upper edge to facilitate insertion of the portion of said complementary electrical connector.

11. An electrical connector assembly according to claim 8 wherein said terminal is bent at said first end to facilitate insertion of the portion of said complementary electrical connector.

12. An electrical connector assembly according to claim 8 wherein said housing has an aperture through said side wall adjacent to said contact beam for insertion of a support therethrough to support said terminal during molding.

13. An electrical connector assembly according to claim 8 wherein said first catch and said tail are generally parallel.

14. An electrical connector assembly according to claim 8 wherein said first catch and said contact beam are generally perpendicular.

15. An electrical connector assembly according to claim 8 wherein said male housing includes a surface of said base having a recess adjacent a junction of said second catch and said soldering tail of each terminal.

* * * * *